US007799689B2

(12) United States Patent
Wen et al.

(10) Patent No.: US 7,799,689 B2
(45) Date of Patent: Sep. 21, 2010

(54) METHOD AND APPARATUS FOR CHEMICAL MECHANICAL POLISHING INCLUDING FIRST AND SECOND POLISHING

(75) Inventors: Chih-Min Wen, Hsinchu (TW); Chen-Hsiang Liao, Hsinchu County (TW)

(73) Assignee: Taiwan Semiconductor Manufacturing Company, Ltd, Hsin-Chu (TW)

( * ) Notice: Subject to any disclaimer, the term of this patent is extended or adjusted under 35 U.S.C. 154(b) by 490 days.

(21) Appl. No.: 11/600,723

(22) Filed: Nov. 17, 2006

(65) Prior Publication Data

US 2008/0119116 A1 May 22, 2008

(51) Int. Cl.
*H01L 21/302* (2006.01)

(52) U.S. Cl. ..... 438/692; 438/691; 438/693; 451/37

(58) Field of Classification Search ..... 438/690, 438/691, 692, 693; 216/89; 451/41, 287, 451/288, 37, 40, 51
See application file for complete search history.

(56) References Cited

U.S. PATENT DOCUMENTS

| | | | | |
|---|---|---|---|---|
| 4,992,135 | A * | 2/1991 | Doan | 438/692 |
| 5,244,534 | A * | 9/1993 | Yu et al. | 438/672 |
| 5,300,155 | A | 4/1994 | Sandhu et al. | |
| 6,066,028 | A * | 5/2000 | Cheng et al. | 451/28 |
| 2003/0051413 | A1 * | 3/2003 | Sakai et al. | 51/307 |
| 2003/0228734 | A1 * | 12/2003 | Natsume et al. | 438/253 |
| 2004/0082275 | A1 * | 4/2004 | Mahulikar et al. | 451/41 |
| 2004/0186206 | A1 * | 9/2004 | Yoneda et al. | 524/95 |
| 2005/0196954 | A1 * | 9/2005 | Noguchi | 438/622 |
| 2005/0218010 | A1 * | 10/2005 | Wang et al. | 205/677 |

* cited by examiner

*Primary Examiner*—Lan Vinh
(74) *Attorney, Agent, or Firm*—Finnegan, Henderson, Farabow, Garrett & Dunner, LLP

(57) ABSTRACT

A method and apparatus for performing first and second polishings on a workpiece wherein the first and second polishings are performed using different operating parameters.

18 Claims, 6 Drawing Sheets

METHOD AND APPARATUS FOR CHEMICAL MECHANICAL POLISHING INCLUDING FIRST AND SECOND POLISHING

TECHNICAL FIELD

The present invention generally relates to a chemical mechanical polishing (CMP) process and apparatus for polishing a workpiece. More particularly, this invention relates to process and apparatus for controlling and removing metallic oxides formed during polishing of metallic structures in semiconductor wafers by varying chemical and mechanical factors of the chemical mechanical polishing.

DESCRIPTION OF THE RELATED ART

CMP is a widely employed technique in semiconductor manufacturing. CMP is typically used to remove a material, such as a metal or oxide, from a workpiece, such as a semiconductor wafer, by polishing. Generally, performing CMP on a semiconductor wafer during fabrication involves mounting the wafer in a rotatable carrier and pressing the carrier and wafer surface to be polished against a polishing pad on a rotating platen. A slurry containing an abrasive material is dispensed onto the polishing pad. Polishing results from a combination of chemical factors relating to the composition of the slurry and mechanical factors relating to physically applying the wafer and its carrier against the polishing pad. As used herein, CMP polish rate refers to the rate at which material is removed from the workpiece being polished. CMP polish rates of the material being removed are governed by the chemical and mechanical factors.

Chemical factors may, for example, include use in the slurry of one or more compounds that enhance formation of a more weakly bonded species of the material being removed, for example, by accelerating formation of a soft metal oxide on the surface of a metal layer being polished. Specific chemical factors which typically affect oxide formation include a concentration of an oxidizer in the CMP slurry. Additional chemical factors may include the resident exposure time of a given slurry on the surface being polished, which may be controlled via slurry flow rates, and the temperature of the slurry.

Mechanical factors may include pressure between the surface to be polished and the polishing pad (i.e., polishing pressure), and rotational rates of the platen and carrier. Such mechanical factors are also chosen to achieve a desired polishing rate for a particular material being removed.

Chemical and mechanical factors are typically balanced against one another to optimize polish rate while minimizing damage to the polished material, surrounding material, and/or semiconductor devices being formed. Pure mechanical polishing is disadvantageous because mechanically driven polishing is slower and micro-scratching can occur. These disadvantages increase production time and reduce yield, respectively. In the case of polishing a metal such as tungsten (W) on a semiconductor wafer, these disadvantages can be overcome by, for example, as shown in FIG. 1, exposing W to an oxidizer, such as hydrogen peroxide ($H_2O_2$) included in the slurry, and then removing the resulting softer oxide, i.e., tungsten oxide ($WO_x$), as shown in FIG. 1, by abrasive and mechanical forces applied through the polishing pad.

Because less mechanical force is necessary to remove $WO_x$ than W, the polishing rate is increased without the need to increase polish pressure. Therefore, less damage occurs to the surface or structure being processed, such as a via formed of W. As the oxide is removed, the metal is again exposed to the chemical agent in the slurry on the surface, which further oxidizes the metal. Using such a combination of chemical and mechanical processes, the CMP process can be monitored by methods well known in the art and is continued until the desired amount of material is removed.

As a consequence of employing chemically enhanced polishing as described above, however, residual oxides and other polishing by-products may remain after polishing when both chemical and mechanical processes are used. Metallic oxide formation, in particular, is disadvantageous when polishing metal structures, vias, or interconnects because such oxides lead to higher resistivity and can reduce the reliability of semiconductor devices if the metallic oxide is not removed.

One method of overcoming this disadvantage is to vary the temperature of a semiconductor wafer or workpiece and/or slurry during CMP. U.S. Pat. No. 5,300,155 to Sandhu et al. appears to disclose varying the CMP process temperature to increase or decrease the chemical reaction and, consequently, the rate of removal of material by primarily chemical or mechanical driven polishes. However, the method described by Sandhu et al. appears to require regulating heating and cooling of the chemical component of a CMP apparatus over a range of temperatures. In addition, there appears to be a need for gathering experimentally determined, temperature-dependent parameters to correctly choose appropriate temperatures to optimize either the mechanical or chemical driven etch rates.

Other methods, such as dipping post-CMP processed wafers into hot deionized water or performing argon (Ar) sputtering, may be effective to remove oxides but increase the number of fabrication steps, which reduces throughput and decreases yield.

Therefore, in order to increase throughput and maintain desirable electrical properties of metallic interconnects or vias contained within semiconductor element formation regions, there is a need for an improved method and apparatus for CMP.

SUMMARY OF THE INVENTION

In accordance with the purpose of the invention as embodied and broadly described, there is provided a chemical mechanical polishing (CMP) method for polishing a workpiece. The method comprises performing a first CMP of the workpiece to remove a portion of a material on the workpiece, the first CMP characterized by chemical factors and mechanical factors; adjusting at least one of the mechanical and chemical factors to increase a polishing effect of the mechanical factors relative to the chemical factors; and performing, following the adjusting, a second CMP of the workpiece.

Also in accordance with the present invention, there is provided a CMP method for polishing a workpiece. The method comprises configuring a first CMP apparatus to remove a portion of a material on a surface of the workpiece to be polished, the first CMP apparatus configured to perform polishing in accordance with predetermined chemical factors and predetermined mechanical factors; performing a first polishing of the workpiece surface on the first CMP apparatus; adjusting at least one of the mechanical and chemical factors to increase a polishing effect of the mechanical factors relative to the chemical factors; configuring a second CMP apparatus to perform a second polishing of the workpiece, after the first polishing, in accordance with the adjusted at least one mechanical and chemical factors; and performing a second polishing of the workpiece surface on the second CMP apparatus.

Further in accordance with the present invention, there is provided a CMP method for polishing a surface of a workpiece using a CMP apparatus that includes a rotatable platen on which a polishing pad is mounted, a rotatable workpiece carrier for holding the workpiece and pressing the workpiece surface to be polished against the polishing pad, and a dispenser to dispense slurry onto the polishing pad. The method comprises performing a first CMP of the workpiece in accordance with mechanical factors including at least one of a pressure at which the workpiece surface is pressed against the platen and a rotation rate of at least one of the rotatable platen and rotatable workpiece carrier, and chemical factors including an oxidizer concentration and a flow rate of the slurry being dispensed onto the polishing pad, the first CMP being performed to remove metal material from the surface of the workpiece until a predetermined end point; changing at least one of the mechanical and chemical factors to increase the effect on CMP of the mechanical factors relative to the chemical factors; and performing a second CMP of the workpiece in accordance the mechanical factors and chemical factors including the at least one of the changed mechanical and chemical factors.

Additional features and advantages of the invention will be set forth in the description that follows, being apparent from the description or learned by practice of the invention. Features and other advantages of the invention will be realized and attained by the CMP method, apparatus, and systems particularly pointed out in the written description and claims, as well as the appended drawings.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

In the drawings.

DESCRIPTION OF THE EMBODIMENTS

Reference will now be made in detail to embodiments of the present invention, examples of which are illustrated in the accompanying drawings. Wherever possible, the same or similar reference numbers will be used throughout the drawings to refer to the same or like parts.

Embodiments consistent with the present invention provide for a method for CMP, an apparatus for CMP, and a system for CMP that enable increased throughput and improved electrical properties of metallic interconnects. Methods, apparatus, and systems that overcome drawbacks associated with the approaches in the related art discussed above, and are consistent with aspects of the present invention will next be described.

Figure 1:
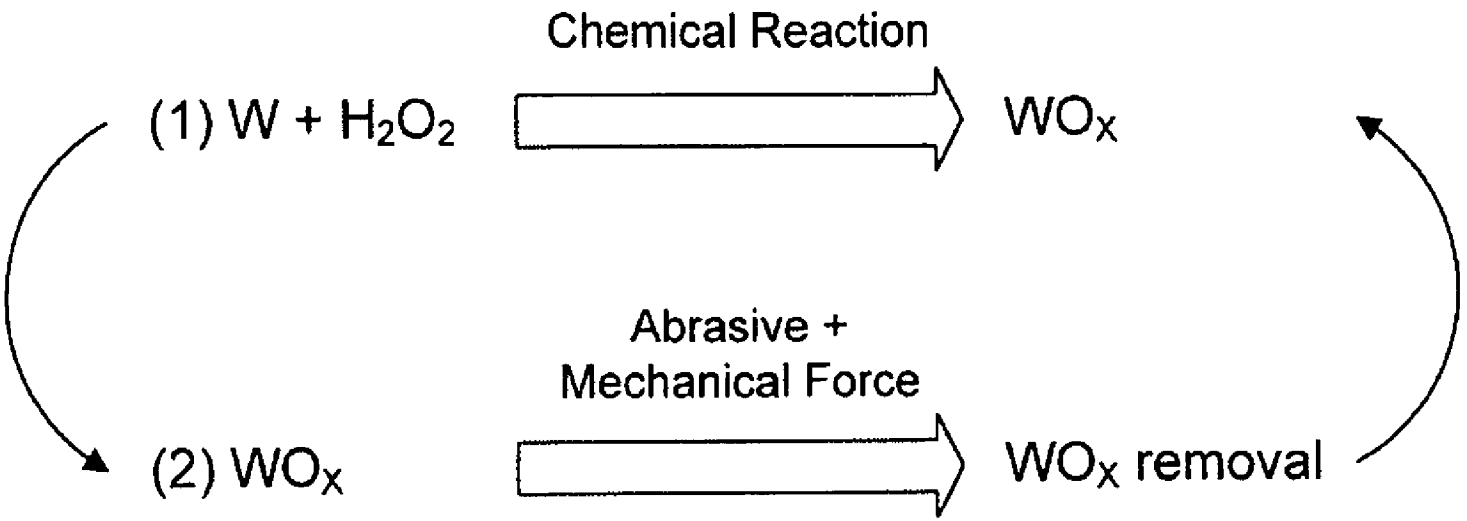
FIG. 1 is an illustrative example of the interaction of chemical and mechanical factors which occurs during CMP of an exemplary material.
Figure 2:
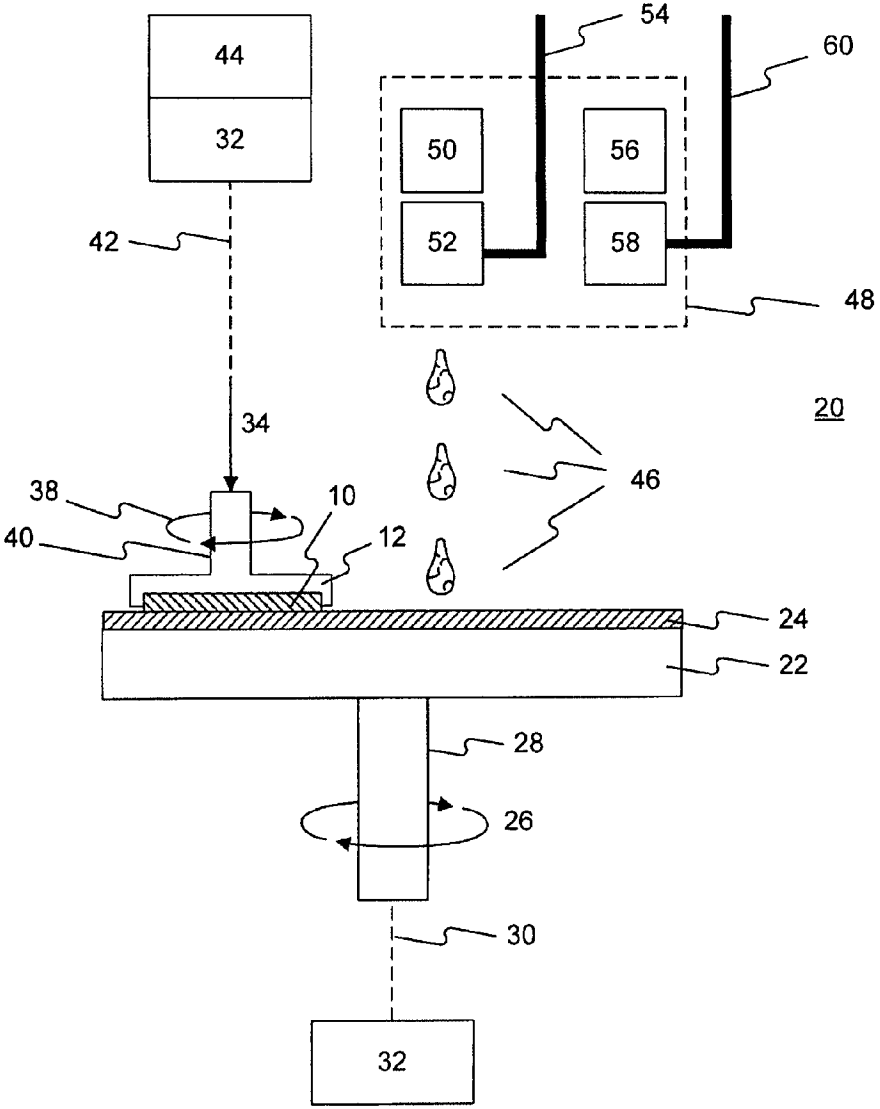
FIG. 2 is an exemplary illustration of a CMP apparatus.

FIG. 2 illustrates an exemplary embodiment of a CMP apparatus. With reference to FIG. 2, a workpiece such as a silicon wafer 10 having semiconductor device formation regions including metal structures, such as metallic interconnect structures, to be polished is mounted in a carrier 12 of a CMP process apparatus 20. Metal structures included in semiconductor devices being formed in wafer 10 may include metals such as tungsten, aluminum, or copper, which may be polished using the CMP processes described herein. CMP process apparatus 20 may be operated at room temperature. CMP apparatus 20 may also include an endpoint detection control scheme (not shown) for determining when sufficient material has been removed by polishing.

Apparatus 20 includes a platen 22 for holding a polishing pad 24. Platen 22 is driven to rotate 26 by a drive shaft 28 about an axis 30 through the center of platen 22. Drive shaft 28 is driven at a variable rate by a controllable driving mechanism 32. A force 34 is applied to carrier 12 to exert a polishing pressure on the surface of wafer 10 against platen 22 in a direction perpendicular to the surfaces of wafer 10 and platen 22. Force 34 may be exerted by a controllable mechanism 36, for example a pneumatic or hydraulic pressure mechanism, coupled to carrier 12. Carrier 12 is driven to rotate 38 by a drive shaft 40 about an axis 42 by a controllable drive mechanism 44.

FIG. 2 also includes other elements which provide additional flexibility for controlling the polish rate provided by a slurry that includes a chemical etchant and/or oxidizer used in the CMP process. A slurry 46 is applied to the surface of polishing pad 24 by a slurry dispensing unit 48 that includes a slurry flow controller ("flow controller") 50 that controls a slurry pump 52 which pumps slurry, having a predetermined composition, fed from a slurry feed pipe 54. Slurry dispensing unit 48 also includes a deionized water controller 56 that controls a deionized water pump 58 which pumps deionized water fed from a deionized water feed pipe 60. The outputs of pumps 52 and 58 are mixed on the polishing pad 24 to control the concentration of slurry 46 by dilution with the deionized water. As a result, the concentration and/or flow rate of slurry 46 can be controlled by slurry dispensing unit 48 and its components.

Suitable structures for mechanisms 32, 36, and 44, dispensing unit 48, and controllers 50 and 52 are known to those skilled in the art and are therefore not described in detail herein. However, as explained more fully below, aspects consistent with the present invention relate to innovative methods of controlling such mechanisms 32, 36, and 44, dispensing unit 48, and controllers 50 and 52, and a CMP apparatus so controlled, in manner that achieve improved CMP operation.

Figure 3:
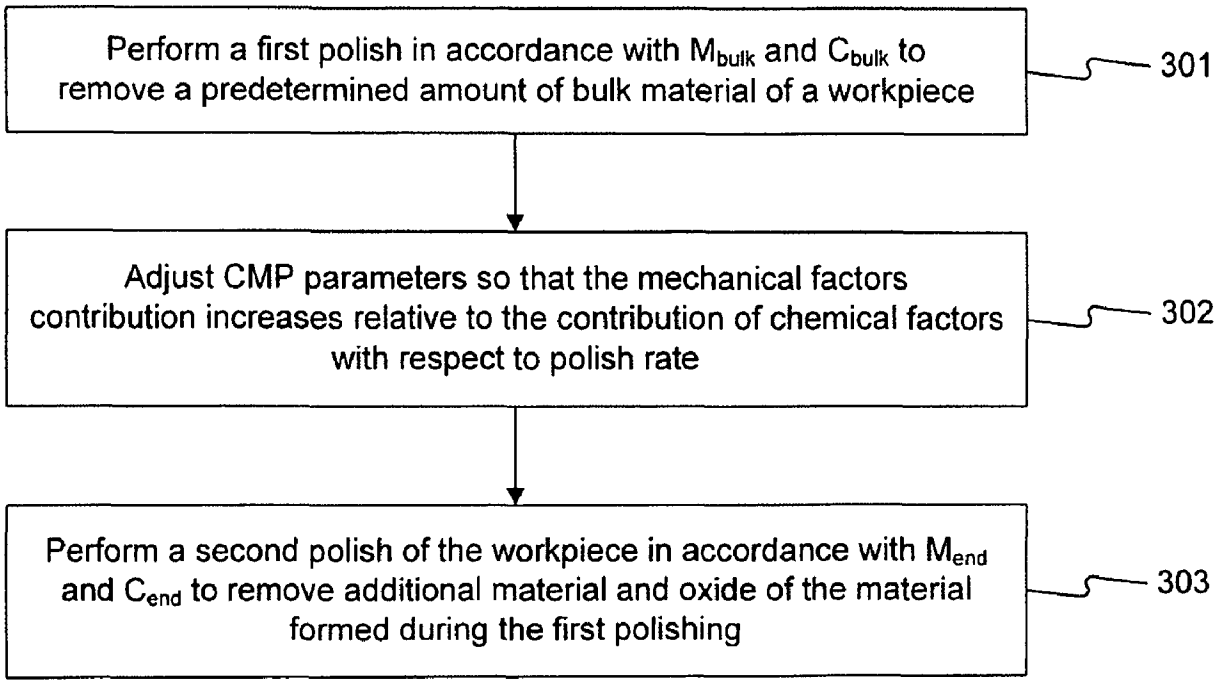
FIG. 3 is a flowchart showing steps of an exemplary embodiment consistent with the present invention.

FIG. 3 is a flowchart showing an exemplary method of performing CMP consistent with embodiments of the present invention. With reference to FIG. 3, a first polish takes place at step 301. Both the first polish, discussed here, and a second polish discussed below, can be carried out at room temperature. The first polish is configured, via parameter selection, to perform polishing for a selected time to remove from a workpiece a predetermined amount, e.g., thickness, of bulk material. In the exemplary embodiment discussed here, the bulk material is a metal suitable for forming conductive interconnecting structures in silicon wafer 10, such as, for example, tungsten, aluminum, or copper. The parameters selected for performing the first polish include mechanical factors such as polishing pressure corresponding to force 34 in FIG. 2, and the rotational rates of both carrier 12 and platen 22, illustrated as rotations 38 and 26, respectively, in FIG. 2. The parameters selected for performing the first polishing further include chemical factors such as an oxidizer concentration of slurry 46 and a flow rate of slurry 46, also shown in FIG. 2. As explained with respect to FIG. 2, the oxidizer concentration may be controlled by controller 52 and the slurry flow rate may be controlled by controller 50.

The polish rate of the CMP process in the first polish step 301 is based on the combination of the mechanical and chemical factors discussed above. In the first polish step 301, selected ones of the mechanical and/or chemical factors are collectively designated $M_{bulk}$ and $C_{bulk}$, respectively, as explained more fully below. The combined effect of the selected factors is represented by the ratio $M_{bulk}/C_{bulk}$. $M_{bulk}/C_{bulk}$ is determined prior to carrying out first polishing step 301.

After the predetermined amount of the bulk material is removed, the first polish is stopped. Then, in step 302, the values of the CMP parameters corresponding to the mechanical and/or chemical factors are altered so as to increase the contribution of the mechanical factors to the polish rate relative to the chemical factors. The same mechanical and chemical factors selected to determine $M_{bulk}$ and $C_{bulk}$ are used to determine a second set of factors designated $M_{end}$ and $C_{end}$, respectively, based on their altered values. Their combined effect is represented by the ratio $M_{end}/C_{end}$. In order to increase $M_{end}$ relative to $C_{end}$, the relevant mechanical factors may be increased and/or the relevant chemical factors may be decreased. Thus, for example, the mechanical factors such as the polishing pressure and/or the rotational rates of either or both of carrier 12 and platen 22 may be increased. Additionally or alternatively, the chemical factors such as the oxidizer concentration and/or the slurry flow rate may be decreased.

The result should be that the representative ratio $M_{end}/C_{end}$ is greater than the representative ratio $M_{bulk}/C_{bulk}$. The combined mechanical and/or chemical factors determining the ratio $M_{end}/C_{end}$ will characterize a second polish to be performed in a next step 303. Thus, the selected mechanical factor(s) play a greater role in second polish step 303 than in first polish step 301.

In order for representative ratios $M_{bulk}/C_{bulk}$ and $M_{end}/C_{end}$ to be quantitatively compatible and comparable, the mechanical and/or chemical factors selected to determine $M_{bulk}$ and $C_{bulk}$ are the same factors selected to determine $M_{end}$ and $C_{end}$. In other words, selected ones of the mechanical factors, such as polish pressure and/or rotational rates, and/or chemical factors, such as oxidizer concentration and/or slurry flow rates are evaluated in both polishing steps 301 and 303 to determine $M_{bulk}/C_{bulk}$ and $M_{end}/C_{end}$. In accordance with one embodiment, the only mechanical and/or chemical factors selected are the ones that are varied during step 302. In a first example of this embodiment, $M_{bulk}/C_{bulk}$ and $M_{end}/C_{end}$ would be solely determined by polish pressure and would have units of psi, if only polish pressure is varied during step 302 between first polishing step 301 and second polishing step 303. In the first example, all other configurable mechanical and chemical factors would remain fixed during polish steps 301 and 303. In a second example of this embodiment, $M_{bulk}/C_{bulk}$ and $M_{end}/C_{end}$ would be solely determined by polish pressure (psi) and slurry flowrate (sccm) and would have units of psi/sccm, if only the polish pressure and the slurry flow rate are varied during step 302. In the second example, all other configurable mechanical and chemical factors would remain fixed during polish steps 301 and 303.

In accordance with another embodiment, the ones of the mechanical and/or chemical factors selected to determine $M_{bulk}$, $C_{bulk}$, $M_{end}$, and $C_{end}$ again include the factors that are varied during step 302, but also include one or more factors that remain fixed during step 302. Consistent with this embodiment, in a third example, $M_{bulk}/C_{bulk}$ and $M_{end}/C_{end}$ would be solely determined by polish pressure (psi) and slurry flow rate (sccm) and those representative ratios would have units of psi/sccm. However, in the third example, only polish rate or only slurry flow rate would be varied in step 302 in a manner resulting in $M_{end}/C_{end}$ being greater than $M_{bulk}/C_{bulk}$. Again as in the first and second examples, all other configurable mechanical and chemical factors would remain fixed during polish steps 301 and 303.

The purpose of changing the CMP mechanical and/or chemical factors in step 302 is to prevent metallic oxide formation on the bulk material being polished. Since metallic oxide formation is typically driven by the chemical reaction between the metal and oxidizer, increasing the mechanical factors relative to the chemical factors will reduce such metallic oxide formation. Thus, in second polish step 303 with the more dominant mechanical factor, the mechanical polish removes oxide more effectively and further removes bulk material or metal, while oxidation is simultaneously reduced or prevented from forming due to the chemical reaction. The second polish is performed using the altered factors represented by $M_{end}/C_{end}$ to remove additional bulk material, as well as residual polish by-products, such as the metallic oxide, formed during the first polish.

A result of second polish 303, in which metal oxide is removed and its further formation is retarded, is improved resistivity of resulting interconnects or other metal structures, without the need for extra process steps such as a hot deionized water rinse or Ar sputter. In addition, no additional temperature control is necessary to effectuate the increased mechanical factor. Instead, the mechanical and/or chemical factors of the second polish are altered in a manner which achieves a desired result without the need for temperature control, i.e., the polish rate can be driven by the choice of a combination of mechanical and chemical factors in which the mechanical factors have an increased effect relative to the first polish.

Figure 4:
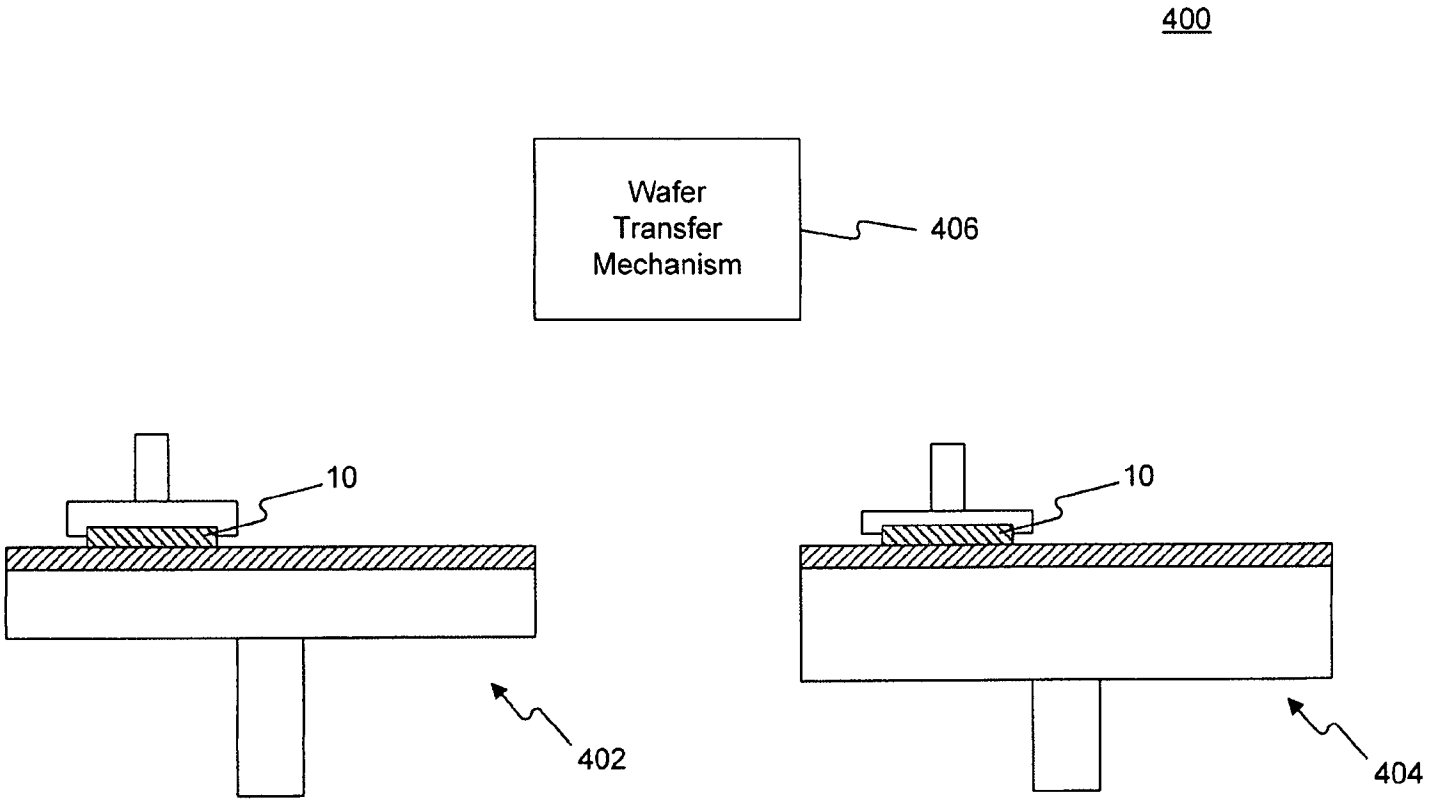
FIG. 4 is an exemplary illustration of a multi-platen CMP apparatus.

FIG. 4 illustrates an exemplary multiple platen system 400 which utilizes multiple CMP apparatuses, including a first CMP apparatus 402 and second CMP apparatus 404. Both first CMP apparatus 402 and second CMP apparatus 404 incorporate the elements shown in CMP apparatus 20. First CMP apparatus 402 and second CMP apparatus 404 are configured to enable transfer of wafer 10 between them by means of a wafer transfer mechanism 406. Wafer transfer mechanism 406 can embody any suitable wafer transfer method known in the art. After performing first polish step 301 on wafer 10 on first CMP apparatus 402, wafer 10 can be transferred by mechanism 406 from first CMP apparatus 402 to second CMP apparatus 404 to perform the second polishing step 303. In other words, first CMP apparatus 402 operates on wafer 10, followed by processing on second CMP apparatus 404, such that first polish step 301 and second polish step 303 are performed in sequence on wafer 10. First CMP apparatus 402 and second CMP apparatus 404 are each configurable to carry out CMP in accordance with selected mechanical and chemical factors. As explained above, the mechanical factors may include polish pressure and rotational rate of the platen and carrier, and the chemical factors may include slurry flow rate and oxidizer concentration of the slurry.

First polish step 301 is performed by first CMP apparatus 402 on wafer 10 in accordance with specific mechanical and chemical factors, e.g., rotational rate of a platen and carrier, polish pressure, a slurry flow rate, and oxidizer concentration of the slurry, and is characterized by the mechanical and/or chemical factors selected to determine the ratio $M_{bulk}/C_{bulk}$. Second polish step 303 is performed by second CMP apparatus 404 on wafer 10 in accordance with the specific mechanical and chemical factors and the variation of one or more of the selected factors that determine the ratio $M_{end}/C_{end}$. The selected mechanical and/or chemical factors for second polish step 303 are varied relative to their values in first polish step 301, in order to provide an increase in mechanical based polishing relative to chemical based polishing. The representative ratio $M_{end}/C_{end}$ that characterizes second polish step 303 is greater than the ratio $M_{bulk}/C_{bulk}$ that characterizes first polish step 301. Multiple platen systems, such as system 400, increase throughput because reconfiguration to perform first polish step 301 and second polish step 303 on an individual CMP process unit is not necessary.

Figure 5:
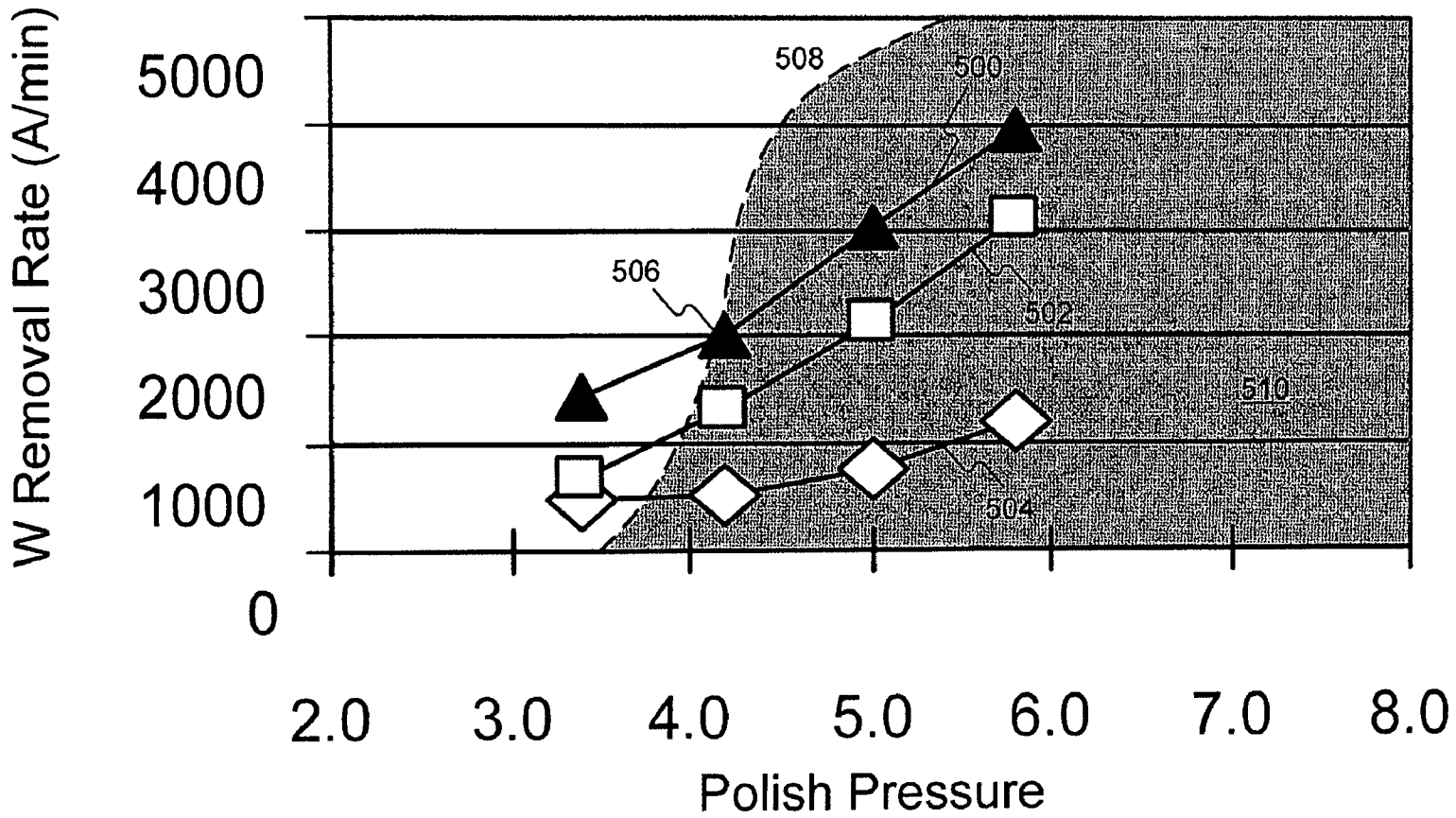
FIG. 5 is a graphical illustration of exemplary rates for a CMP process practiced in accordance with an exemplary embodiment consistent with the present invention.

FIG. 5 is a graphical illustration of test results obtained from operation of CMP apparatus for different combinations of mechanical and chemical factors. Polishing was performed on a standard CMP tool. More particularly, the graph in FIG. 5 illustrates the results of removing tungsten (W) from a wafer by CMP for different values of polishing pressure and slurry flow rates and concentration. In this regard, the abscissa of the graph represents polishing pressure in units of pounds per square inch (psi), while the ordinate represents a removal rate of W in units of angstroms/minute.

In FIG. 5, triangular-shaped data points correspond to a slurry flow rate of 120 sccm, and represent W removal rates for increasing values of polishing pressure, i.e., at pressures of 3.4, 4.2, 5.0, and 5.8 (psi). Together, the triangular data points form a characteristic curve 500. The square data points correspond to a lower slurry flow rate of 80 sccm, and represent W removal rates at the same increasing polishing pressures as for the triangular data points. Together, the square data points form a characteristic curve 502. The diamond-shaped data points correspond to the same slurry flow rate of 80 sccm as for the square data points, but with the slurry diluted with deionized water in a ratio of flow rates at 1:1 (80 sccm slurry: 80 sccm deionized water). The diamond-shaped data points represent W removal rates at the same increasing polishing pressures as for the triangular and square data points. Together, the diamond-shaped data points form a characteristic curve 504. The slurry used in each example shown in FIG. 5 is a silica based slurry including an $H_2O_2$ oxidizer. The concentration of the $H_2O_2$ is 2.4%.

Once the polish etch rates are determined for various combinations of chemical factors, such as slurry flow rate and slurry oxide concentration, and by mechanical factors, such as polish pressure and rotational rates, a point 506 is chosen as $M_{bulk}/C_{bulk}$, which represents an acceptable polish rate for a given combination of mechanical and chemical factors that result in the polish rate for bulk W. A boundary 508 is chosen to define a working area 510. As discussed above, $M_{bulk}/C_{bulk}$ is quantitatively tied to $M_{end}/C_{end}$ by selection of selected CMP parameters corresponding to the mechanical and chemical factors and fixing all other parameters not varied in step 302.

A second polish rate, $M_{end}/C_{end}$, is chosen within working area 510 and is defined by a suitable combination of mechanical and chemical factors such that the contribution of the mechanical factors to the CMP polish rate is greater than that of the chemical factors. In the illustrative example, points within working area 510 are representative of a plurality of candidate values for $M_{end}/C_{end}$ for which the contribution of the mechanical factor of polish pressure is greater than the chemical factor contribution of the slurry flow rate and/or oxidizer concentration of the slurry to the polish rate of the illustrated CMP process in comparison to point 506. As discussed above, $M_{bulk}/C_{bulk}$ and $M_{end}/C_{end}$ are both determined on the basis of the same selected mechanical and chemical factors varied in step 302, such that the units of $M_{end}/C_{end}$ are the same as the units of $M_{bulk}/C_{bulk}$.

Thus, using FIG. 5, parameters consistent with a suitable value of $M_{end}/C_{end}$ are selected such that $M_{end}/C_{end}>M_{bulk}/C_{bulk}$. First polish step 301 and second polish step 303 are then performed in sequence with a combination of mechanical and chemical factors which produce polish rates corresponding to $M_{bulk}/C_{bulk}$ and $M_{end}/C_{end}$, respectively.

Figure 6A:
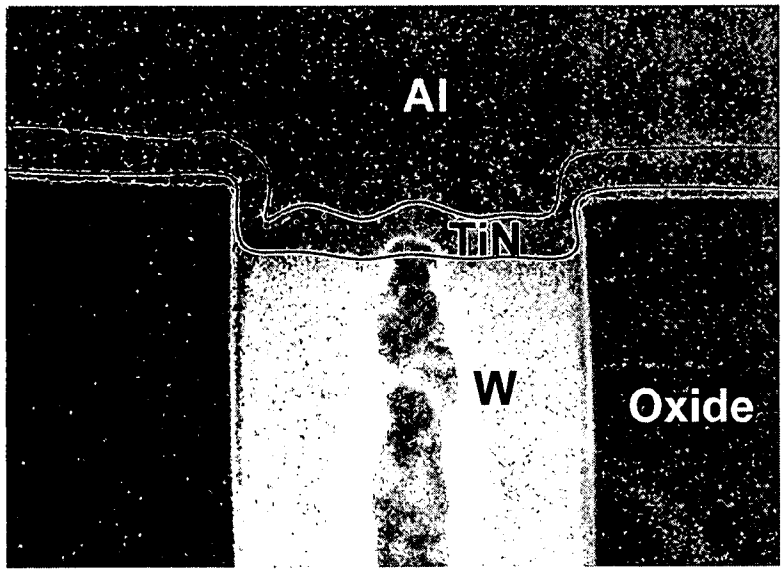
FIG. 6A is a cross-sectional SEM micrograph of an $WO_x$ free W structure including aluminum (Al) and titanium nitride (TiN) formed in a metal stack using a CMP process in accordance with an exemplary embodiment described herein.
Figure 6B:
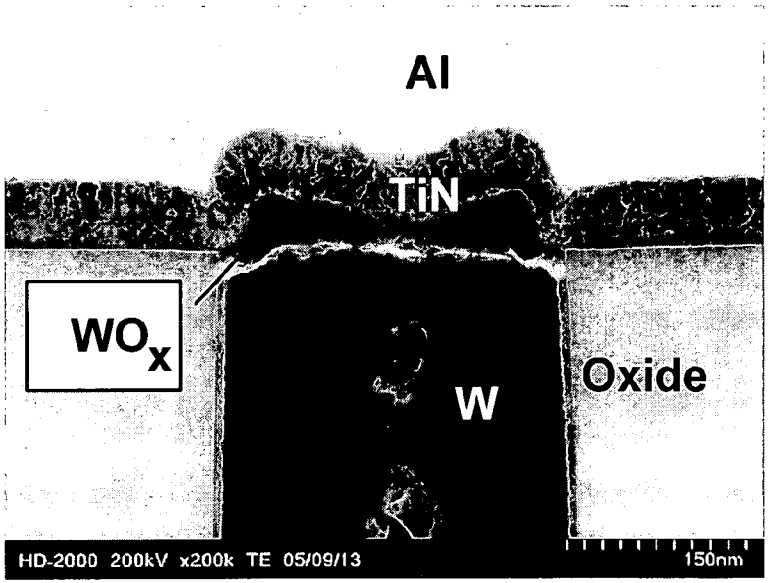
FIG. 6B Prior Art
FIG. 6B is a cross-sectional SEM micrograph of a W structure including Al and TiN formed in a metal stack with residual $WO_x$, formed using a conventional CMP process.

FIGS. 6A and 6B illustrate comparative SEM micrographs of illustrative metal stacks formed using a CMP process consistent with an embodiment of the invention herein (FIG. 6A) and formed using a conventional CMP polish as described below (FIG. 6B). The metal stack illustrated in FIG. 6A was formed using a first polish, consistent with first polish 301, and a second polish, consistent with second polish 303. The aforementioned first and second polishes were performed using combinations of chemical and mechanical factors producing polish rates corresponding to $M_{bulk}/C_{bulk}$ and $M_{end}/C_{end}$, respectively, wherein $M_{end}/C_{end}>M_{bulk}/C_{bulk}$. In contrast, the metal stack illustrated in FIG. 6B was formed by first and second CMP processes using the same factors, such as those consistent with first polish 301, but without altering the mechanical factor contribution relative to the chemical factor. In other words, the stack formed in FIG. 6B was formed without altering the second polish such that it was carried out at a polish rate consistent with $M_{bulk}/C_{bulk}$.

The metal stack shown in FIG. 6A consists of an Al, TiN, and W stack, and was formed by the following process. After forming an oxide and a trench therein, the trench was filled with W. Then, a CMP process using first polish step 301 and second polish step 303, having a first polish rate corresponding to $M_{bulk}/C_{bulk}$ and a second polish rate corresponding to $M_{end}/C_{end}$, respectively, was performed to remove W.

Still with reference to the formation of the metal stack shown in FIG. 6A, first polish step 301 was performed at a first polish rate using mechanical factors, such as polish pressure and a rotational rate of a platen and/or carrier, consistent with $M_{bulk}$, and also performed using chemical factors, such as a concentration of an oxidizer of a slurry and a slurry flow rate consistent with $C_{bulk}$. To remove $WO_x$ resulting from first polish step 301, second polish step 303 was performed at a second polish rate and included reconfiguring the CMP apparatus to use different mechanical factors and/or chemical factors which were consistent with $M_{end}$ and $C_{end}$, respectively, such that $M_{end}/C_{end}>M_{bulk}/C_{bulk}$. After second polish step 303 was performed, TiN and Al were deposited on the polished W using methods well known in the art. Regions of W, TiN, Al, and oxide are denoted in FIG. 6A.

As illustrated in FIG. 6A, no $WO_x$ was present in the stack after CMP processing using first polish step 301 and second polish step 303. In addition, Kelvin test structures formed using the above described CMP process showed significantly better contact resistance performance than structures formed using a conventional CMP process. The contact resistance for structures formed using first polish step 301 and second polish step 303 was between about 1.5~4 ohms.

In contrast, an Al/TiN/$WO_x$/W stack illustrated in FIG. 6B was formed using a conventional CMP process. After filling a trench formed in an oxide with W, the W was polished using the conventional CMP process. The conventional CMP process, consisting of a conventional polish followed by an overpolish, was performed. The overpolish is a finishing polish used to remove CMP by-products such as $WO_x$ which remained on the W after the conventional polish. The conventional polish and overpolish were both performed using the same chemical and mechanical factors as used in first polish step 301 to polish the W material in the illustrative embodiment FIG. 6A. For example, the same mechanical factors, such as the polishing pressure and rotational rate of the platen and/or carrier, as well as the same chemical factors, such as the oxidizer concentrations of the slurries and slurry flow rates, were used during both the conventional polish and overpolish.

The overpolish failed to remove the $WO_x$ formed during the conventional polish. After deposition of TiN and Al on the W polished using a conventional CMP process, the resulting stack was the Al/TiN/$WO_x$/W stack shown in FIG. 6B. As seen in FIG. 6B, the $WO_x$ was not removed by the overpolish. Furthermore, the contact resistance, obtained from Kelvin test structures formed using the conventional polish and overpolish, was higher for the Al/TiN/$WO_x$/W stack and varied between about 1.5~100 ohms.

While slurries containing an oxidizer to soften a metal have been described above, persons of ordinary skill in the art will now recognize that the invention can be performed with the use of other types of slurries that have different chemical effects on the material to be polished.

It will also be apparent to those skilled in the art that various modifications and variations can be made in the disclosed structures and methods without departing from the scope or spirit of the invention. Other embodiments of the invention will be apparent to those skilled in the art from consideration of the specification and practice of the invention disclosed herein. It is intended that the specification and examples be considered exemplary only, with a true scope and spirit of the invention being indicated by the following claims.

What is claimed is:

1. A chemical mechanical polishing (CMP) method for polishing a workpiece, comprising:

performing a first CMP of the workpiece to remove a portion of a metal on the workpiece, the first CMP characterized by chemical factors and mechanical factors;

adjusting at least one of the mechanical or chemical factors to increase a polishing effect of the mechanical factors relative to the chemical factors; and performing, following the adjusting, a second CMP of the workpiece to further remove the metal on the workpiece, the first and second CMP removing the metal without substantially removing an adjacent insulating material, wherein:

the chemical factors associated with the first CMP are collectively defined as $C_{bulk}$, the mechanical factors associated with the first CMP are collectively defined as $M_{bulk}$, the chemical factors associated with a second CMP are collectively defined as $C_{end}$, the mechanical factors associated with a second CMP are collectively defined as $M_{end}$, $M_{end}$ and $C_{end}$ are chosen such that $M_{end}/C_{end}>M_{bulk}/C_{bulk}$, the first CMP of the workpiece is performed in accordance with $M_{bulk}$ and $C_{bulk}$, and the second CMP of the workpiece is performed in accordance with $M_{end}$ and $C_{end}$.

2. The CMP method according to claim 1, further comprising performing the first CMP and second CMP at room temperature.

3. The CMP method according to claim 1, further comprising:

mounting the workpiece in a rotatable workpiece carrier, for providing a polishing pressure to the workpiece;

pressing the workpiece mounted in the carrier against a polishing pad mounted on a rotatable platen;

pressing a workpiece surface to be polished against the polishing pad with a polishing pressure; and rotating each of the rotatable carrier and rotatable platen at respective rotational rates, wherein the mechanical factors include at least one of the polishing pressure and the respective rotational rates of the carrier and the platen.

4. The CMP method according to claim 1, further including providing the workpiece as a wafer including semiconductor devices.

5. The CMP method according to claim 1, wherein the metal on the workpiece includes a metal selected from a group consisting of tungsten, aluminum, and copper.

6. The CMP method according to claim 5, further comprising dispensing a slurry onto the workpiece during polishing and controlling an oxidizer concentration and a slurry flow rate for the slurry, wherein the chemical factors include at least one of the oxidizer concentration of the slurry and the slurry flow rate.

7. A chemical mechanical polishing (CMP) method for polishing a workpiece comprising:

configuring a first CMP apparatus to remove a portion of a metal on a surface of the workpiece to be polished, the first CMP apparatus configured to perform polishing in accordance with predetermined chemical factors and predetermined mechanical factors;

performing a first polishing of the workpiece surface on the first CMP apparatus;

adjusting at least one of the mechanical or chemical factors to increase a polishing effect of the mechanical factors relative to the chemical factors;

configuring a second CMP apparatus to perform a second polishing of the workpiece, after the first polishing, in accordance with the adjusted at least one mechanical and chemical factors; and performing a second polishing of the workpiece surface to further remove the metal on the workpiece on the second CMP apparatus, the first and second polishing removing the metal without substantially removing an adjacent insulating material, wherein:

the chemical factors associated with the first polishing are collectively defined as $C_{bulk}$, the mechanical factors associated with the first polishing are collectively defined as $M_{bulk}$, the chemical factors associated with the second polishing are collectively defined as $C_{end}$, the mechanical factors associated with the second polishing are collectively defined as $M_{end}$, $M_{end}$ and $C_{end}$ are chosen such that $M_{end}/C_{end}>M_{bulk}/C_{bulk}$, the first polishing of the workpiece surface is performed in accordance with $M_{bulk}$ and $C_{bulk}$, and the second polishing of the workpiece surface is performed in accordance with $M_{end}$ and $C_{end}$.

8. The CMP method according to claim 7, further comprising:

providing the first CMP apparatus with a first rotatable platen;

mounting a first polishing pad on the first rotatable platen;

mounting the workpiece in a rotatable workpiece carrier;

pressing the workpiece surface against the first polishing pad to perform the first polishing;

rotating one of the first rotatable platen and the rotatable workpiece carrier at a first rotational rate and applying a first polish pressure to press the workpiece surface to be polished against the first polishing pad of the first CMP apparatus during the first polishing;

providing the second CMP apparatus with a second rotatable platen;

mounting a second polishing pad on the second rotatable platen; and pressing the workpiece surface against the second polishing pad to perform the second polishing;

wherein the adjusting includes configuring the second CMP apparatus to provide at least one of a different rotational rate than the first rotational rate and a different polish pressure than the first polish pressure used by the first CMP apparatus.

9. The CMP method according to claim 7, further comprising:

mounting a first polishing pad on the first rotatable platen;

mounting the workpiece in a rotatable workpiece carrier;

dispensing a first slurry having a first slurry oxidizer concentration at a first slurry flow rate on the first polishing pad from a first slurry dispenser;

performing the first polishing on the workpiece surface by pressing the workpiece surface against the first polishing pad;

providing the second CMP apparatus with a second rotatable platen and a second polishing pad mounted thereon;

wherein the adjusting includes providing a second slurry having a second slurry oxidizer concentration at a second slurry flow rate on the second polishing pad, at least one of the second slurry oxidizer concentration and second slurry flow rate being different from the first slurry oxidizer concentration and first slurry flow rate, respectively; and performing the second polishing on the workpiece surface by pressing the workpiece surface against the second polishing pad while dispensing the second slurry at the second slurry flow rate.

10. The CMP method according to claim 7, further comprising providing a metal selected from a group consisting of tungsten, aluminum, and copper to the workpiece as the metal.

11. The CMP method according to claim 7, further comprising performing the first polishing and the second polishing at room temperature.

12. A chemical mechanical polishing (CMP) method for polishing a surface of a workpiece using a CMP apparatus that includes a rotatable platen on which a polishing pad is mounted, a rotatable workpiece carrier for holding the workpiece and pressing the workpiece surface to be polished against the polishing pad, and a dispenser to dispense slurry onto the polishing pad, the method comprising:

performing a first CMP of the workpiece in accordance with mechanical factors including at least one of a pressure at which the workpiece surface is pressed against the platen and a rotation rate of at least one of the rotatable platen and rotatable workpiece carrier, and chemical factors including an oxidizer concentration and a flow rate of the slurry being dispensed onto the polishing pad, the first CMP being performed to remove metal material from the surface of the workpiece until a predetermined end point;

changing at least one of the mechanical or chemical factors to increase the effect on CMP of the mechanical factors relative to the chemical factors; and performing a second CMP of the workpiece in accordance the mechanical factors and chemical factors including the at least one of the changed mechanical and chemical factors, the second CMP being performed to further remove the metal material from the surface of the workpiece without substantially removing an adjacent insulating material of the workpiece, wherein:

the chemical factors associated with the first CMP are collectively defined as $C_{bulk}$, the mechanical factors associated with the first CMP are collectively defined as $M_{bulk}$, the chemical factors associated with the second CMP are collectively defined as $C_{end}$, the mechanical factors associated with the second CMP are collectively defined as $M_{end}$, $M_{end}$ and $C_{end}$ are chosen such that $M_{end}/C_{end}>M_{bulk}/C_{bulk}$, the first CMP on the surface of the workpiece is performed in accordance with $M_{bulk}$ and $C_{bulk}$, and the second CMP on the surface of the workpiece is performed in accordance with $M_{end}$ and $C_{end}$.

13. The method of CMP according to claim 12, wherein the metal material is selected from a group consisting of tungsten, aluminum, and copper.

14. The method of CMP according to claim 12, further comprising performing the first CMP and the second CMP at room temperature.

15. The CMP method according to claim 12, further comprising:

controlling a first rotational rate of the rotatable platen on which the polishing pad is mounted;

controlling a second rotational rate of the rotatable workpiece carrier for holding the workpiece;

controlling the pressure at which the workpiece surface to be polished is pressed against the polishing pad; and wherein the changing includes changing at least one of the mechanical factors from a group including the first rotational rate, the second rotational rate, and the pressure.

16. The CMP method according to claim 12, further comprising:

controlling the flow rate of a slurry dispensed onto a polishing pad;

controlling the oxidizer concentration of the slurry; and wherein the changing includes changing at least one of the chemical factors from a group including the flow rate of the slurry and the oxidizer concentration of the slurry.

17. The CMP method according to claim 12, wherein the metal material being removed is selected from a group consisting of tungsten, aluminum, and copper.

18. The CMP method according to claim 12, further comprising performing the first CMP and second CMP at room temperature.

* * * * *